United States Patent [19]

Miura

[11] Patent Number: 4,906,880

[45] Date of Patent: Mar. 6, 1990

[54] ELECTROMAGNETIC VALVE HAVING REDUCED HYSTERESIS

[75] Inventor: Yasushi Miura, Nagoya, Japan

[73] Assignee: Aisin Seiki Kabushiki Kaisha, Kariya, Japan

[21] Appl. No.: 330,489

[22] Filed: Mar. 30, 1989

[30] Foreign Application Priority Data

Mar. 30, 1988 [JP] Japan ..... 63-74797

[51] Int. Cl.[4] ..... H01H 7/08

[52] U.S. Cl. ..... 310/29; 251/129.15; 251/65; 335/258

[58] Field of Search ..... 251/129.15, 65; 310/12, 310/30, 256, 29, 36; 335/229, 230, 234, 279; 137/528

[56] References Cited

U.S. PATENT DOCUMENTS

| | | | |
|---|---|---|---|
| 4,419,643 | 12/1983 | Ojima et al. | 335/234 |
| 4,463,332 | 7/1984 | Everett | 335/258 |
| 4,791,958 | 12/1988 | Brundage | 137/528 |
| 4,835,503 | 5/1989 | Everett | 335/230 |

*Primary Examiner*—Patrick R. Salce
*Assistant Examiner*—D. L. Rebsch
*Attorney, Agent, or Firm*—Oblon, Spivak, McClelland, Maier & Neustadt

[57] ABSTRACT

In an electromagnetic valve, the fixed core of a solenoid has an axially extending annular wall at one end. The movable core of the solenoid is connected to a poppet for closing a fluid passage of a valve seat member and is fittable in the recess defined by the annular wall. The magnetic flux flow path including the annular wall provides reduced hysteresis for the initial part of the stroke of the poppet upon energization of the solenoid.

5 Claims, 3 Drawing Sheets

ELECTROMAGNETIC VALVE HAVING REDUCED HYSTERESIS

BACKGROUND OF THE INVENTION

1. Field of the Invention

This invention relates generally to an electromagnetic valve which electromagnetically and proportionally controls the pressure of the operational fluid of a hydraulic or pneumatic circuit.

2. Statement of Related Art

According to known electromagnetic valves, even when a constant electric current is supplied to the valve the electromagnetic force is unstable in response to the position of the poppet due to hysteresis generated during travel of the poppet.

SUMMARY OF THE INVENTION

Accordingly, it is an object of the present invention to provide a solution to the above conventional drawbacks.

It is another object of the present invention to provide an improved electromagnetic valve which decreases the undesired hysteresis during the stroke of the poppet valve member.

The above and other objects are accomplished according to the present invention by an electromagnetic valve which comprises a solenoid having a coil wound on a bobbin and a fixed core extending through the bobbin, one end of the fixed core having an axially protruding annular wall defining a recess at one end. A poppet includes a valve member portion and a magnetic portion, the magnetic portion being fittable into the recess so as to comprise a movable core of the solenoid. A valve seat member forms a fluid passage which can be closed by the valve member portion. A magnetic flux flow path of the solenoid includes the annular wall so that hysteresis of an initial stroke of the poppet is minimized.

According to a further feature of the invention, a spring biases the magnetic portion out of the recess when the solenoid is deenergized, and the valve member portion closes the fluid passage when the solenoid is deenergized. The spring is fitted in a longitudinal bore of the fixed core.

According to a further feature of the invention, the outer surface of the annular wall is tapered such that the annular wall has a progressively reduced thickness with increased distance from the one end of the fixed core.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
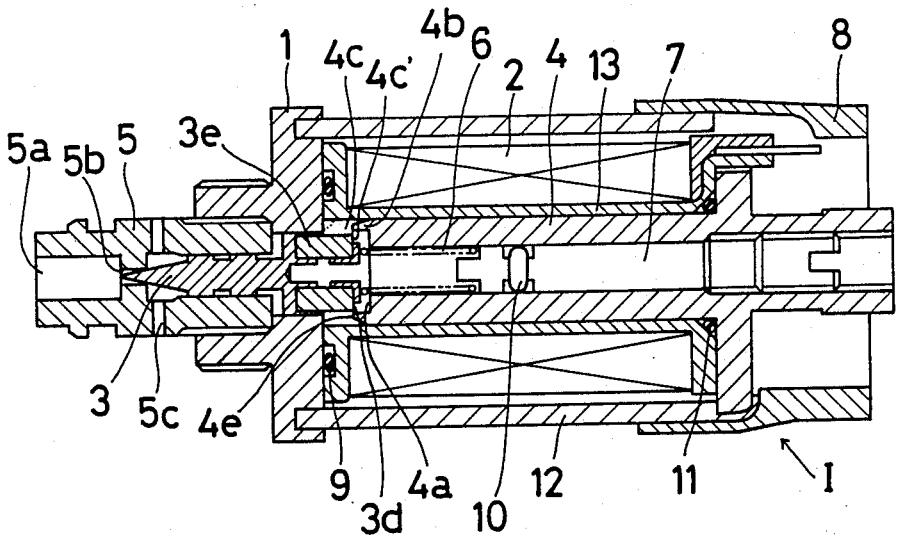
FIG. 1 is a sectional view showing a first embodiment I of the invention.

Referring now to the drawings, the electromagnetic pressure valve I has a generally cylindrical form defined by a casing 12. A cap 1 is connected to the casing 12 at one axial end thereof, while a dust cover 8 is attached to the other axial end of the casing 12. A valve seat member 5 is threaded into a flange of the cap 1.

The casing 12 houses a solenoid 2 wound about a bobbin 13. A fixed core 4 extends through the bobbin and has a longitudinal bore which houses an adjuster screw 7. A compression coil spring 6 fits in the bore and bears against the adjuster screw 7, and also bears against a poppet 3.

The O-ring 9 provides sealing between the bobbin 13 and the cap 1. The O-ring 10 provides sealing within the bore of the fixed core. The O-ring 11 provides sealing between the bobbin 13 and the fixed core 4.

The fixed core 4 includes a planar front end **4*a* and an annular wall 4*b* extending axially outwardly from the front end 4*a* and coaxial with the fixed core to form a recess. The inner annular surface 4*c* of the wall 4*b* is parallel to the axis of the fixed core and the outside surface 4*d* thereof has a tapered shape as shown in FIG. 1. The tip end 4*e* of the fixed core 4** has a circular end surface.

The poppet 3 includes an annular magnetic member **3*c* formed of magnetic material and connected to the right end of the poppet 3. The outer periphery of the magnetic member 3*c* is tightly fittable in the recess within the inner surface 4*c* of the fixed core 4. The illustrated position of the poppet 3 shows the valve is in its closed position. The poppet 3 has a valve member portion that normally closes fluid passage 5*b* in the valve seat member 5. When the poppet 3 is moved to the right, fluid communication between the inlet and outlet ports 5*a* and 5*c* in the valve seat member 5 will be established through the restricted fluid passage 5*b***.

Since the core 4 has the tapered outside surface **4*d*, when the magnet member 3*c* is moved so as to fit into the recess at the one end of the core and closely adjacent the inner surface 4*c* of the fixed core, magnetic flux generated in the magnet circuit formed by the fixed core 4 and magnet member 3*c* will not be weakened, due to the tapered shape of the end of the core 4. Thus the electromagnetic force defined by the axial pulling force between the core 4 and the poppet 3 is larger than the required force over the entire stroke of the poppet 3, as shown in FIG. 2**.

Figure 2:
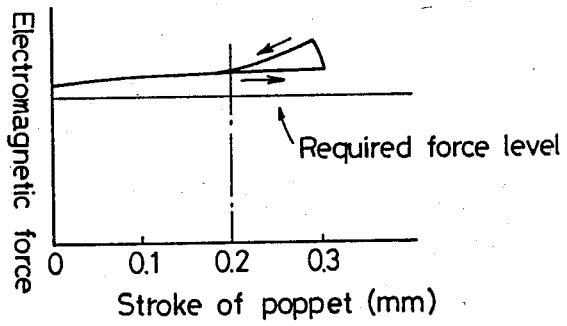
FIG. 2 shows a characteristic of the embodiment shown in FIG. 1.

As seen in FIG. 2, the characteristic of the electromagnetic valve is approximately constant from 0 to 0.3 mm of the stroke of the poppet during separation from the seat 5. From 0.3 to 0.2 mm of the stroke of the poppet, when approaching the seat 5, the electromagnetic force is gradually decreased and from 0.2 to 0 mm of the stroked of the poppet, the force is again constant. Further, from 0.3 to 0.2 mm of the stroke, a hysteresis exists, but from 0.2 mm of the stroke no hysteresis is generated to the initial position.

Figure 3:
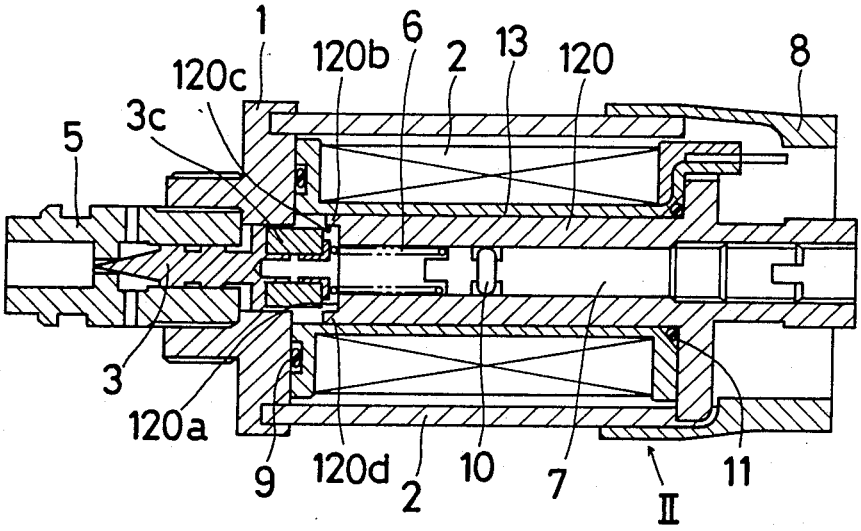
FIG. 3 is a sectional view showing a second embodiment II of the invention.
Figure 4:
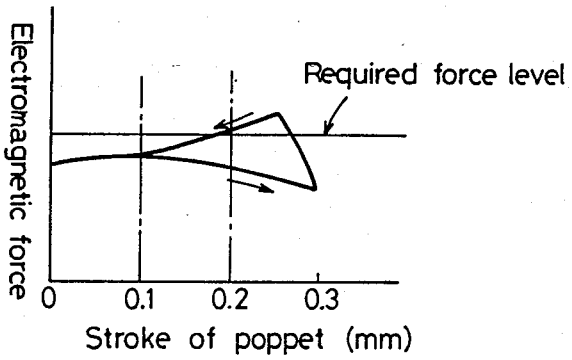
FIG. 4 shows a characteristic of the embodiment shown in FIG. 3.

According to the second embodiment in FIG. 3, the electromagnetic valve II includes a fixed core 120 having a front end **120*a*, an annular wall 120*b* extending perpendicular to the front end 120***a* and extending axially of the core. The outer and inner surfaces 120*c* and 120*d* of the wall 120*b* are parallel to the axis of the fixed core 120. The other parts and components are the same as the first embodiment in FIG. 1, and the details thereof are omitted. FIG. 4 shows the characteristic of the valve II of the second embodiment in FIG. 3. The hysteresis is seen from 0.1 to 0.2 mm of the stroke or from 0.3 to 0.1 mm of the stroke, but the electromagnetic force increases or decreases gradually in proportion to the stroke of the poppet 3.

Figure 5:
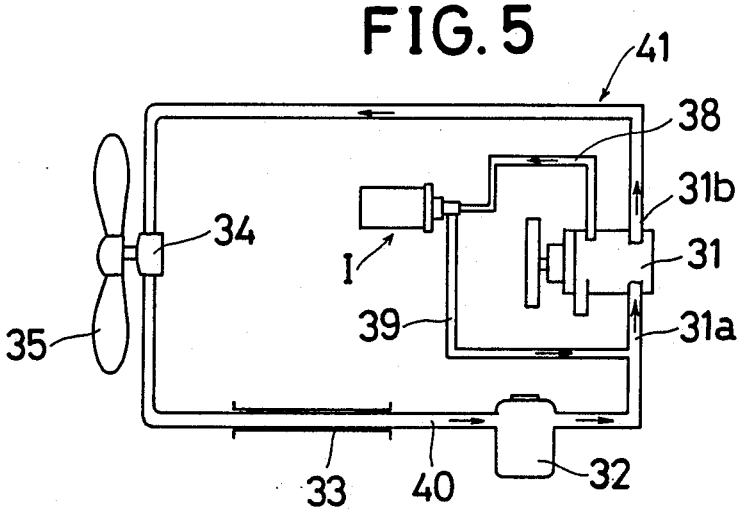
FIG. 5 and FIG. 6 show a motor driven fan system including the electromagnetic valve I of the present invention.
Figure 6:
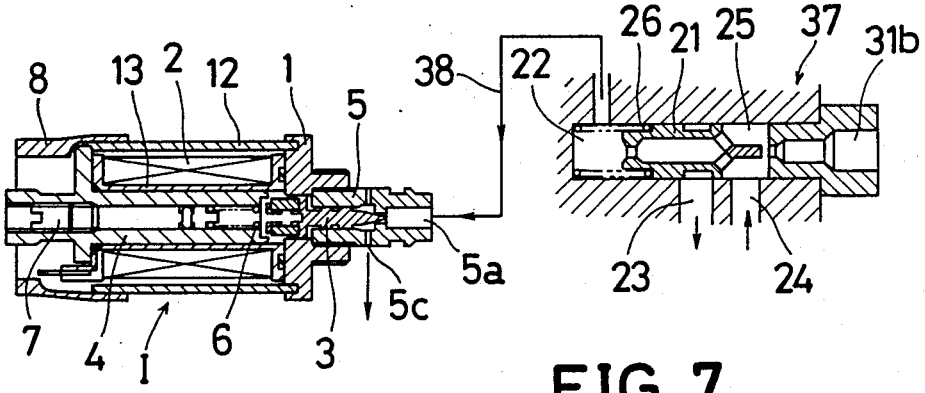

FIG. 5 and FIG. 6 shows the application of the electromagnetic valve I to a hydraulic fan system. The hydraulic circuit 41 includes a hydraulic motor 34 which drives a fan 35. The pump 31 deliver hydraulic pressure via outlet port 31*b* and returns the oil via the inlet port 31*a*. The pump 31 includes an outlet pressure control valve 37 shown in FIG. 6. The control valve 37 includes a pressure chamber 22 connected to the passage 38 which is in turn connected to the inlet port 5*a* of the electromagnetic valve I of FIG. 1. The control valve 37 further includes a valve chamber 25 at pump pressure and a valve spool 21 disposed between the pressure chamber 22 and the valve chamber 25. The spool is biased to the right direction as viewed in FIG. 6 by spring 26 disposed in the pressure chamber 22. The spool receives dynamic pressure from a passage 24 which is connected to the pump main passage and receives static pressure at the pressure chamber 22 and due to the spring force of spring 26. Relief passage 23 is connected to the pump inlet port 31*a*. The spool 21 is movable in the axial direction by the pressure difference between the pressure chamber 22 and the valve chamber 25 to relieve the pressure at the valve chamber 25 into the relief passage 23 so as to control keep the pressure at the outlet port 31*b*. Returning to FIG. 5, the motor 34 is connected to reservoir tank 32 via oil cooler 33 and the return passage 40.

When the electromagnetic valve I is not energized, the poppet 3 closes communication between the passages 38 and 39 so that the pressure in the pressure chamber 22 is constant. If the pump pressure exceeds a predetermined value, the pressure in the valve chamber 25 moves the spool 21 to the left (as seen in FIG. 6), permitting pump pressure to bypass to the pump inlet 31*a*. This predetermined pressure will remain constant so long as the electromagnetic valve I is not energized, since the pressure chamber 22 is isolated by the closure of the fluid passage 5*b* in the valve seat member 5 by the poppet 3.

When the electromagnetic valve I is energized so as to open fluid passage 5*b*, the pressure chamber 22 is communicated with the pump inlet 31*a*, and so the predetermined pressure becomes a function of the suction pressure of the pump. Because there is no hysteresis at the initial part of the stroke of the poppet, the opening and closing of the communication between passages 38 and 39 by movement of the poppet is surely controlled in proportion to the degree of energizing electricity to the solenoid.

Figure 7:
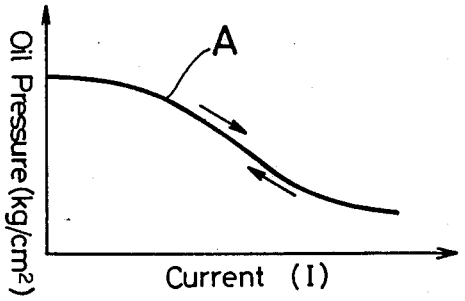
FIG. 7 shows another characteristic of the invention according to FIG. 1.

It is thus possible to regulate the pump outlet pressure at the port 31*b*. The relationship between the current applied to the solenoid 2 and the pump pressure at the outlet port 31*b* is shown in FIG. 7. As can there be seen, the loop A has a very small hysteresis.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. An electromagnetic valve comprising:

a solenoid comprising a coil wound on a bobbin and a fixed core extending through said bobbin so as to form a magnetic path with said coil, one end of said fixed core having an axially protruding annular wall defining a recess at said one end;

a poppet including a valve member portion and a magnetic portion, said magnetic portion being fittable into said recess so as to comprise a movable core of said solenoid during an end part of a stroke, and a valve seat member forming a fluid passage, wherein said valve member portion is movable during said stroke into a position for closing said fluid passage, whereby a magnetic flux flow path of said solenoid includes said annular wall during said end part of said stroke so that hysteresis of an initial part of said stroke of said poppet is minimized, wherein an outer surface of said annular wall is tapered such that said annular wall has a progressively reduced thickness with increased distance from said one end.

2. The electromagnetic valve of claim 1 including means for biasing said magnetic portion out of said recess when said solenoid is deenergized, wherein said valve member portion is in said position for closing said fluid passage when said solenoid is deenergized.

3. The electromagnetic valve of claim 1 wherein said fixed core comprises a cylinder having a longitudinal bore extending to said one end and wherein said annular wall surrounds said bore.

4. The electromagnetic valve of claim 2 wherein said fixed core comprises a cylinder having a longitudinal bore extending to said one end and wherein said annular wall surrounds said bore.

5. The electromagnetic valve of claim 4 wherein said biasing means comprises a spring fitted in said bore.

* * * * *